US006848696B2

(12) United States Patent
Miller

(10) Patent No.: US 6,848,696 B2
(45) Date of Patent: Feb. 1, 2005

(54) CART FOR INJURED PERSON

(76) Inventor: Michael S. Miller, 1742 Caris Schenkel Dr., Linton, IN (US) 47441

( * ) Notice: Subject to any disclaimer, the term of this patent is extended or adjusted under 35 U.S.C. 154(b) by 0 days.

(21) Appl. No.: 10/603,529

(22) Filed: Jun. 25, 2003

(65) Prior Publication Data

US 2004/0012165 A1 Jan. 22, 2004

Related U.S. Application Data

(63) Continuation of application No. 09/990,079, filed on Nov. 21, 2001, now Pat. No. 6,634,660.

(51) Int. Cl.[7] ..... A63H 3/00

(52) U.S. Cl. ..... 280/87.021; 482/66; 482/68; 135/67

(58) Field of Search ..... 280/87.021, 87.1, 280/87.041, 87.05, 304.1, 30, 657, 638; 297/5; 5/81.1 R; 482/66–69; 135/66, 67, 74; 119/725, 726, 727, 814

(56) References Cited

U.S. PATENT DOCUMENTS

| | | | | | |
|---|---|---|---|---|---|
| 1,668,623 | A | * | 5/1928 | Avril | 280/87.021 |
| 4,748,994 | A | * | 6/1988 | Schultz et al. | 135/67 |
| 4,867,188 | A | * | 9/1989 | Reid | 135/67 |
| 5,005,825 | A | * | 4/1991 | Fogel | 482/60 |
| 5,086,798 | A | * | 2/1992 | Motts | 135/67 |
| 5,158,313 | A | * | 10/1992 | Becker | 280/87.021 |
| 5,167,597 | A | * | 12/1992 | David | 482/68 |
| 5,291,909 | A | * | 3/1994 | Skorman et al. | 135/67 |
| 5,323,664 | A | * | 6/1994 | Fairfield et al. | 74/551.3 |
| 5,411,035 | A | * | 5/1995 | Stone | 128/845 |
| 5,702,326 | A | * | 12/1997 | Renteria | 482/68 |
| 5,746,236 | A | * | 5/1998 | Tilsley et al. | 135/66 |
| 5,800,317 | A | * | 9/1998 | Accetta | 482/66 |
| 5,839,740 | A | * | 11/1998 | Seeger | 280/87.021 |
| 6,023,023 | A | * | 2/2000 | Takeuchi | 174/92 |
| 6,053,189 | A | * | 4/2000 | Longenecker et al. | 135/67 |
| 6,099,002 | A | * | 8/2000 | Uchiyama | 280/87.021 |
| 6,123,089 | A | * | 9/2000 | Fish | 135/67 |
| 6,149,170 | A | * | 11/2000 | Dotson | 280/87.021 |
| 6,634,660 | B2 | * | 10/2003 | Miller | 280/87.021 |
| 2003/0137119 | A1 | * | 7/2003 | Razon | 280/87.021 |

FOREIGN PATENT DOCUMENTS

| | | | | |
|---|---|---|---|---|
| GB | 2127705 A | * | 4/1984 | A61H/3/00 |
| GB | 2185716 A | | 7/1987 | |

* cited by examiner

*Primary Examiner*—Christopher P. Ellis
*Assistant Examiner*—J. Allen Shriver
(74) *Attorney, Agent, or Firm*—Bose McKinney & Evans LLP

(57) ABSTRACT

A cart for an injured person is provided. The cart includes a frame, a leg support member coupled to the frame, and a plurality of wheels coupled to the frame. The plurality of wheels is moveable between a first asymmetrical position relative to the frame and a second asymmetrical position relative to the frame, thereby accommodating a person having a non-ambulatory lower left leg or a non-ambulatory lower right leg, respectively.

20 Claims, 5 Drawing Sheets

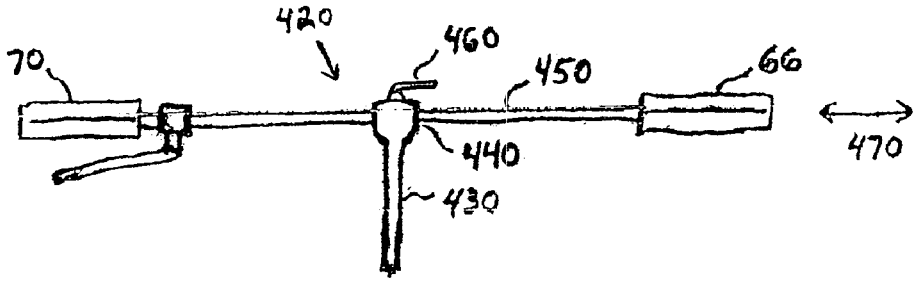
FIG. 4
FIG. 5
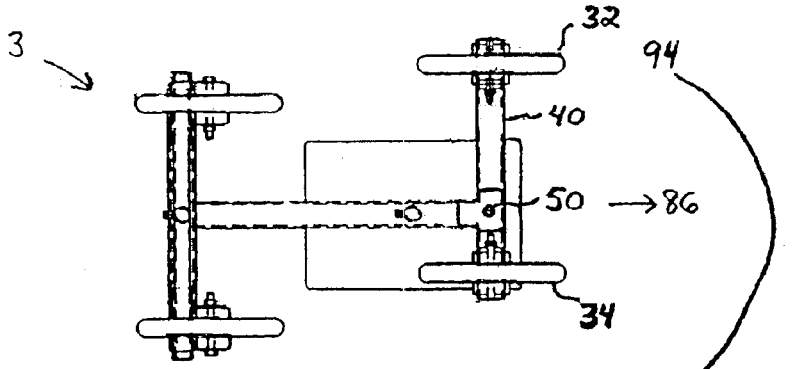
FIG. 6
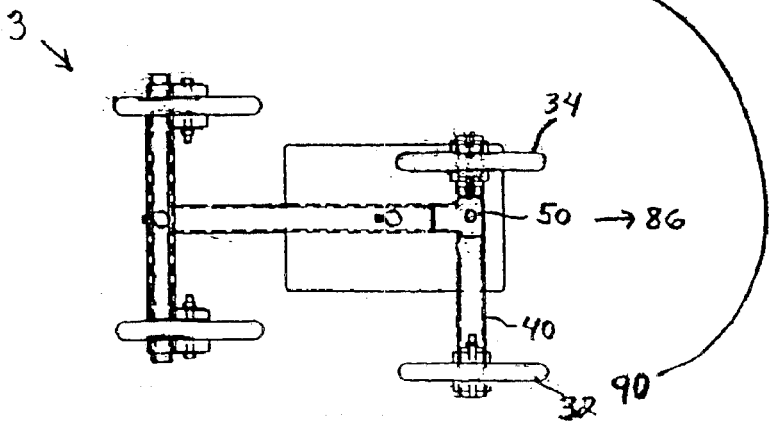

CART FOR INJURED PERSON

RELATED APPLICATIONS

This application is a continuation of application Ser. No. 09/990,079 filed Nov. 21, 2001 now U.S. Pat. No. 6,654,660, the disclosure of which is hereby expressly incorporated by reference.

FIELD OF THE INVENTION

The present invention relates the locomotion of a person having a non-ambulatory lower leg. More particularly, the invention relates to a cart for an injured person including a plurality of wheels that is moveable between a first asymmetrical position relative to the frame and a second asymmetrical position relative to the frame, thereby accommodating a person having a non-ambulatory lower left leg or a non-ambulatory lower right leg, respectively.

BACKGROUND

Various self-propelled carts, scooters, walkers, etc. for the locomotion of a person who has one non-ambulatory lower leg and one ambulatory leg are known. Typically, the person rests his or her non-ambulatory lower leg on a surface supported by a wheeled frame, while using his or her ambulatory leg for propulsion.

A problem with such devices has been their instability. In short, they have been undesirably prone to tipping over during operation. Another problem with such devices has been their lack of versatility. Devices made specifically for a person having a non-ambulatory lower left leg have not been suitable for a use by person having a non-ambulatory lower right leg, and vice-versa. Prior devices have not fully addressed both of these issues.

For example, U.S. Pat. No. 5,800,317 to Accetta ("Accetta") discloses a four-wheeled walker with a side extension that serves as an outrigger to give the wheels of the walker an asymmetrical arrangement relative to a center axis of the vehicle. Accetta is directed to the instability problem, but the walker that Accetta teaches lacks versatility, as it is dedicated to either a left or a right leg.

Meanwhile, U.S. Pat. No. 5,839,740 to Seeger ("Seeger") discloses a three-wheeled cart. The two front wheels of the cart are fixed. The rear (third) wheel is attached to a leg support assembly that is configured to be attached to either a left or a right side of the cart. This allows reconfiguration of the cart to accommodate either a left or a right leg, but the three-wheeled cart is inherently less stable than a four-wheeled vehicle.

There is, therefore, a need for a stable, yet versatile cart for an injured person.

SUMMARY OF THE INVENTION

The present invention provides a cart for an injured person. The cart includes a frame, a leg support member coupled to the frame, and a plurality of wheels coupled to the frame. The plurality of wheels is moveable between a first asymmetrical position relative to the frame and a second asymmetrical position relative to the frame, thereby accommodating a person having a non-ambulatory lower left leg or a non-ambulatory lower right leg, respectively.

The above-noted features and advantages of the present invention, as well as additional features and advantages, will be readily apparent to those skilled in the art upon reference to the following detailed description and the accompanying drawings.

BRIEF DESCRIPTION OF THE DRAWINGS

FIG. 4 is a front view of yet another alternative handlebar according to the present invention;

FIG. 5 is a bottom view of the cart of FIG. 1 with wheels positioned to accommodate a person having a non-ambulatory lower left leg and an ambulatory right leg;

FIG. 6 is a bottom view of the cart of FIG. 1 with wheels positioned to accommodate a person having a non-ambulatory lower right leg and an ambulatory left leg;

DETAILED DESCRIPTION OF EXEMPLARY EMBODIMENTS

Figure 1:
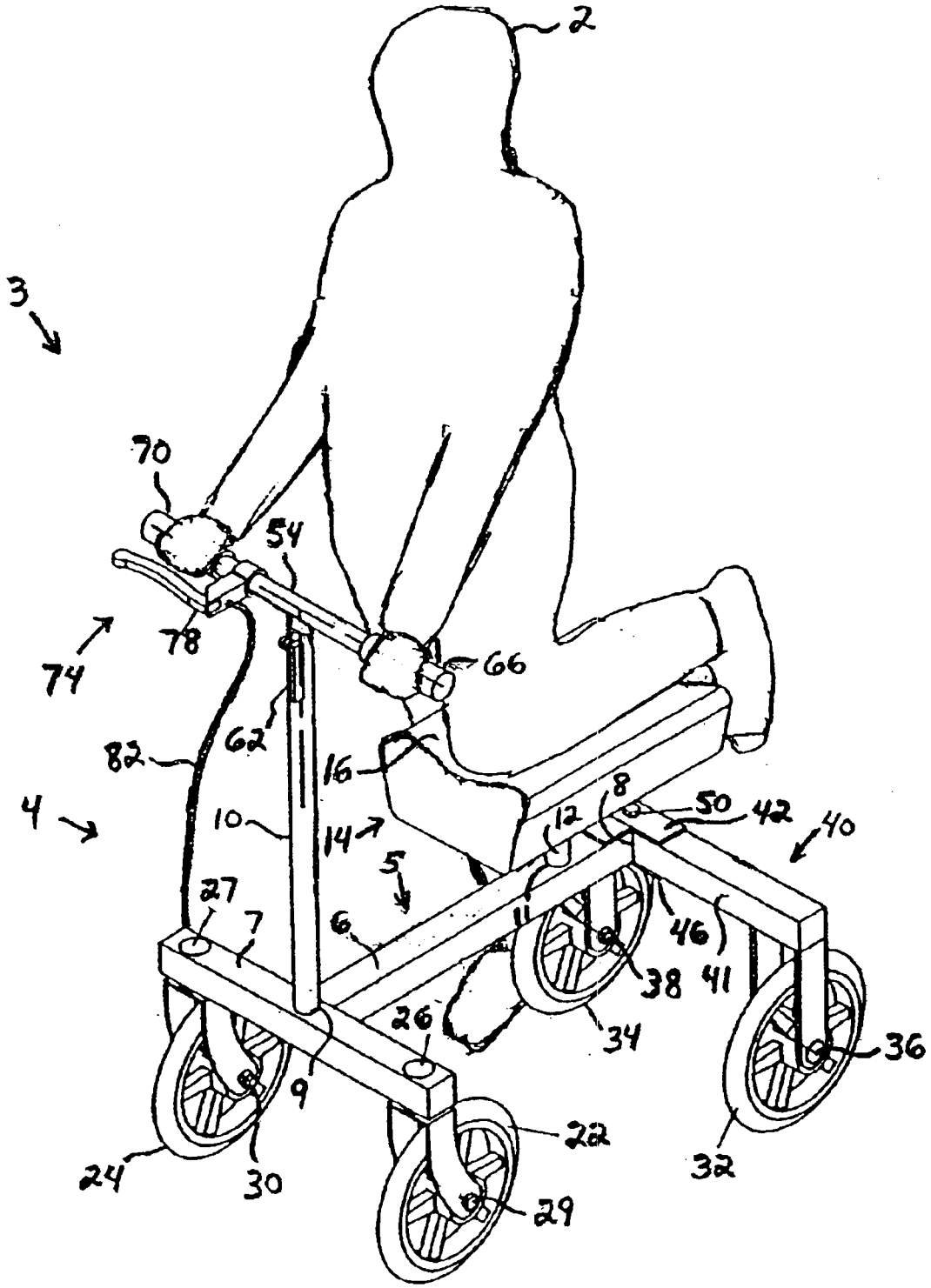
FIG. 1 is a perspective view of a person operating a cart according to the present invention.

FIG. 1 is a perspective view of a person 2 operating a cart 3 according to the present invention. Cart 3 includes a frame 4, a leg support 14, a left front wheel 22, a right front wheel 24, a left vertical axle 26, a right vertical axle 27, a left horizontal axle 29, a right horizontal axle 30, a first rear wheel 32, a second rear wheel 34, a left horizontal axle 36, a right horizontal axle 38, a coupling bar 40, an upper coupling flange 42, a lower coupling flange 46, a bolt 50, a handlebar 54, a handgrip 66, a handgrip 70, a handbrake 74.

As shown in FIG. 1, frame 4 provides general support to the cart similar to the support typically provided by a bicycle or tricycle frame. Accordingly, frame 4 may be manufactured from the same materials and with the same type of equipment used in the production of similar devices such as scooters, tricycles, wheelchairs, shopping carts, walkers, etc. In the exemplary embodiment described herein, frame 4 is made from sections of steel tubing that are suitably bent into shape and welded together. The steel tubing is thin walled cold rolled steel. If desired, ends of the tubing may be capped by a plastic or metal plug for strength. Alternatively, frame 4 may be constructed from carbon fibers, aluminum, titanium, chrome molly, stainless steel, or any other suitable material.

Frame 4 includes a substantially T-shaped base 5, which is formed by a longitudinal bar 6 that is welded to a transverse bar 7. Remote from the connection of longitudinal bar 6 and transverse bar 7, longitudinal bar 6 has a substantially planar or substantially flat end 8. At a transverse midpoint 9 of transverse bar 7, frame 4 includes an anterior sleeve 10 that is welded to transverse bar 7 and extends upwards therefrom. At a site 11 on longitudinal bar 6 that is spaced apart from substantially flat end 8 but closer to substantially flat end 8 than to transverse bar 7, frame 4 includes a posterior sleeve 12 that is welded to longitudinal bar 6 and extends upwards therefrom.

Leg support 14 supports a user's non-ambulatory lower leg in operation as discussed in further detail below. The interior structure (not shown) of leg support 14 may be extruded aluminum, molded plastic, carbon fibers, or aluminum, stainless steel, steel plate, or any other suitable material. The exterior of leg support 14 is padded with foam rubber or any other suitable material and is covered with vinyl or any other suitable material. Additionally, leg support 14 includes a roughly concave surface 16 for encouraging centering of the non-ambulatory lower leg. Further, leg support 14 includes a tubular member or post 18 (see FIG. 7, FIG. 8, FIG. 9, and FIG. 10) which extends downward into posterior sleeve 12 of frame 4 for securing leg support 14 to frame 4 in a manner similar to that of the typical attachment of a bicycle seat to a bicycle frame. The engagement between leg support 14 and frame 4 may include a quick disconnect mechanism 20 such as, for example, a cam operated pinch lock, to facilitate adjustments to the height of leg support 14 (see FIG. 7, FIG. 8, FIG. 9, and FIG. 10). Various ways of implementing suitable quick disconnect arrangements are well known.

Left front wheel 22 and right front wheel 24 help facilitate propulsion and maneuvering of cart 3. Accordingly, left front wheel 22 and right front wheel 24 are rotatable wheels, preferably in the form of castors. As such, left front wheel 22 and right front wheel 24 preferably have a respective left vertical axle 26 and right vertical axle 27 where they are attached to the frame 4 and a respective left horizontal axle 29 and right horizontal axle 30 from which the wheel of the castor rotates. To enhance the aesthetics of the cart 3, the upward facing ends of left vertical axle 26 and right vertical axle 27 may be covered with finishing plugs. In the embodiment shown in FIG. 1, left front wheel 22 and right front wheel 24 are positioned symmetrically relative to the frame; that is, they are roughly equidistant from longitudinal bar 6 and anterior sleeve 10.

Left front wheel 22 and right front wheel 24 each has a pliable tire and is of such size and construction that no heavy resistance is encountered when the wheels are rotated on flat ground or slightly uneven surfaces such as grass or gravel. The tires may be made of rubber, thermoplastic rubber, super tough nylon, or any other suitable material and they may be pneumatic or non-pneumatic. It should be appreciated that the nonmarking type tires typically used on wheelchairs should be suitable for this application.

First rear wheel 32 and second rear wheel 34 also help facilitate propulsion and maneuvering of cart 3. First rear wheel 32 and second rear wheel 34 are rotatable wheels, however, in the exemplary embodiment they are not castors. Accordingly, first rear wheel 32 and second rear wheel 34 have a respective left horizontal axle 36 and right horizontal axle 38 about which they rotate, but they do not have vertical axles. Nevertheless, it is noted that in alternative embodiments, first rear wheel 32 and second rear wheel 34 may be castors. Further, it is noted that alternative embodiments of cart 3 may include more or less than two rear wheels. In any event, first rear wheel 32 and second rear wheel 34 have tires as discussed above in connection with left front wheel 22 and right front wheel 24.

Coupling bar 40 extends laterally between first rear wheel 32 and second rear wheel 34 as shown. Coupling bar 40 includes a substantially planar or substantially flat side 41 that abuts substantially flat end 8 of longitudinal bar 6. Upper flange 42 and lower flange 46 are planar, substantially T-shaped pieces which are welded to longitudinal bar 6 of frame 4 in proximity to substantially flat end 8 of frame 4. Upper flange 42 and lower flange 46 extend over and under coupling bar 40, respectively, to effectively sandwich coupling bar 40 and secure it (and thus, first rear wheel 32 and second rear wheel 34) vertically relative to frame 4. It is noted that in the embodiment shown in FIG. 1, upper flange 42 and lower flange 46 do not wrap behind coupling bar 40. When installed, bolt 50 extends through apertures in upper flange 42, coupling bar 40, and lower flange 46 (in FIG. 1, bolt 50 occupies the apertures) into a hex nut (not shown), thereby securing coupling bar 40 (and thus, first rear wheel 32 and second rear wheel 34) to frame 4 in a horizontal plane roughly defined by longitudinal bar 6 and transverse bar 7. Accordingly, it should be appreciated that coupling bar 40 is removably coupled to frame 4 by upper flange 42, lower flange 46, and bolt 50. To this end, removing bolt 50 frees coupling bar 40 to be pulled rearwardly away and separated from frame 4 (see directional arrow 86 of FIG. 5 and FIG. 6). Further, it should be appreciated that because the aperture in coupling bar 40 which receives bolt 50 is not equally spaced between first rear wheel 32 and second rear wheel 34 (i.e., it is offset, or closer to one of the wheels than the other), coupling bar 40 asymmetrically mounts first rear wheel 32 and second rear wheel 34 to frame 4. In other words, when coupling bar 40 is secured to frame 4, one of first rear wheel 32 and second rear wheel 34 is laterally closer to leg support 14 than the other (see also FIG. 5 and FIG. 6, discussed below). In any event, it is noted that the embodiments shown in the figures are merely exemplary, and the asymmetrical mounting may be suitably implemented with quick disconnect mechanisms rather than bolt 50, with sliding engagements or tracks that allow for repositioning of first rear wheel 32 and second rear wheel 34 without substantially separating them from frame 4, or in any other suitable manner. Additionally, it should be appreciated that in alternative embodiments coupling bar 40 may couple any of a wide number of wheels to frame 4 in addition to or in lieu of first rear wheel 32 and second rear wheel 34, some of which it may couple to frame 4 in a substantially symmetrical manor. It should be appreciated, however, that because the position of the aperture in coupling bar 40 (that receives bolt 50) is fixed relative to first rear wheel 32 and second rear wheel 34, the embodiment shown in FIG. 1 provides predetermined positioning of first rear wheel 32 and second rear wheel 34 relative to frame 4, which ensures that these wheels are properly positioned for stability and reduces setup time.

Referring still to FIG. 1, handlebar 54 includes a tubular member or post 58 (see FIG. 7 and FIG. 8) which extends downward into anterior sleeve 10 of frame 4 for securing handlebar 54 to frame 4 in a manner similar to that of the typical attachment of bicycle handlebar to a bicycle frame. The engagement between handlebar 54 and frame 4 may include a quick disconnect mechanism 62 such as, for example, a cam operated pinch lock, to facilitate adjustments to the height of handlebar 54 (see also FIG. 7, FIG. 8, FIG. 9, and FIG. 10). Further, it should be appreciated that quick disconnect mechanism 62 also allows handlebar 54 to be easily loosened and rotated 180 degrees about a vertical axis (roughly defined by anterior sleeve 10) to position handbrake 74 (handbrake 74 is discussed in further detail below) for operation by either a left hand or a right hand of person 2. Various ways of implementing suitable quick disconnect arrangements are well known.

To ensure a secure grip, handgrip 66 and handgrip 70 handlebar 54 are fitted onto handlebar 54. Handgrip 66 and handgrip 70 are made from rubber or any other suitable material. In the embodiment shown in FIG. 1, FIG. 5, FIG. 6, FIG. 7, FIG. 8, FIG. 9, and FIG. 10, handlebar 54 is symmetrically mounted to frame 4. In other words, handgrip 66 and handgrip 70 are substantially laterally equidistant from tubular member or post 58. To positively brake cart 3, handbrake 74 is attached to handlebar 54. Handbrake 74 includes an operating lever 78 attached to a distal end of handlebar 54, and a brake cable 82 that couples operating lever 78 to an associated brake caliper (not shown). The caliper grips opposing sides of right front wheel 24 to brake cart 3 when the operating lever 78 is activated, as is well known with these types of brakes. It should be appreciated that while only one brake is shown, cart 3 may be configured with two brakes, one attached to each end of handlebar 54, in which case the additional calipers may be applied to the other front wheel. Furthermore, it should be readily appreciated that in the case of one brake, the brake may be suitably coupled to either end of handlebar 54 and may be applied to either front wheel.

Figure 2:
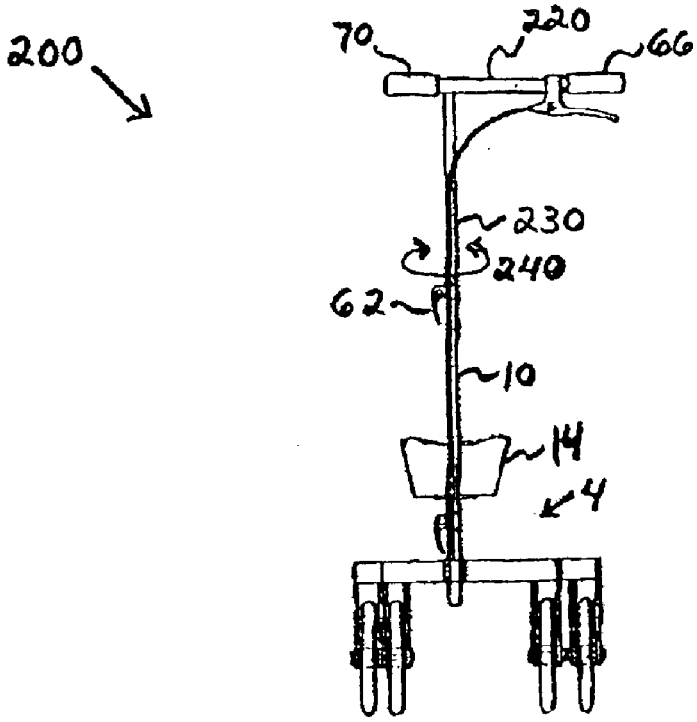
FIG. 2 is a front view of a cart having an alternative handlebar according to the present invention.

FIG. 2 is a front view of a cart 200 having an alternative handlebar 220 according to the present invention. Aside from handlebar 220, the remaining components of cart 200 are identical to the corresponding components of cart 3 (see FIG. 1). Here, it is noted that in the embodiment shown in FIG. 1 the symmetrical mounting of handlebar 54 may result in a slight degree of undesirable lateral shifting of the upper body of person 2 relative to the lower body of person 2, as person 2 does not actually straddle leg support 14 (which differs somewhat from the manner is which one typically sits on a bicycle, where the handlebars and the seat are typically more in alignment). Handlebar 220 includes a substantially vertical tubular member or post 230 that extends downward into anterior sleeve 10 of frame 4 for securing handlebar 220 to frame 4 in a manner similar to the typical attachment of bicycle handlebar to a bicycle frame. However, contrary to handlebar 54 (FIG. 1), handlebar 220 is asymmetrically mounted to frame 4. In other words, handgrip 70 is laterally closer to post 230 than handgrip 66. This asymmetrical mounting may shift the upper body of person 2 to compensate somewhat for not actually straddling leg support 14. Additionally, asymmetrically mounted handlebar 220 may provide accommodation for a person who may favor either his or her left or right upper body due to illness or injury. It should be appreciated that quick disconnect mechanism 62 facilitates adjustments to the height of handlebar 220, and allows handlebar 220 to be rotated 180 degrees about a vertical axis (roughly defined by anterior sleeve 10) for moving handlebar 220 between a first predetermined position which may tend to shift the upper body to the left and a second predetermined position which may tend to shift the upper body to the right (see directional arrows 240).

Figure 3:
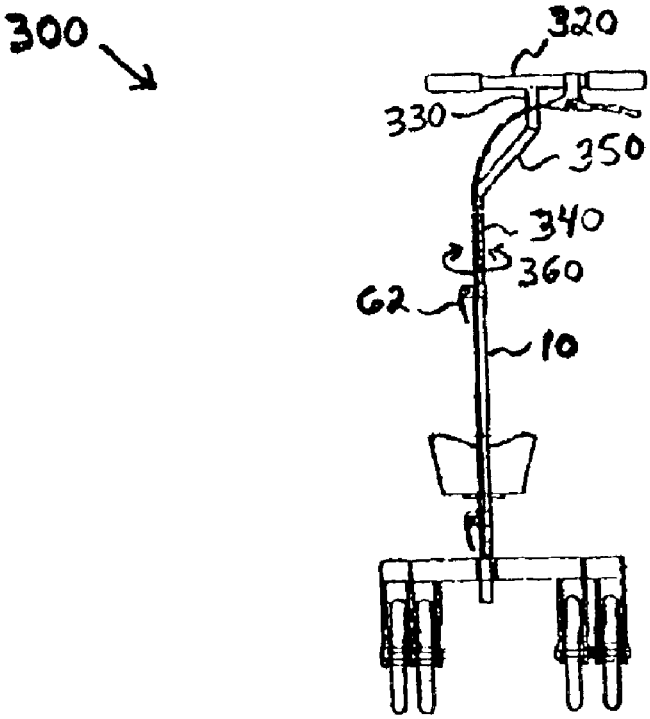
FIG. 3 is a front view of a cart having another alternative handlebar according to the present invention.

FIG. 3 is a front view of a cart 300 having another alternative handlebar 320 according to the present invention. Aside from handlebar 320, the remaining components of cart 300 are identical to the corresponding components of cart 3 (FIG. 1). As noted above in connection with FIG. 2, the symmetrical mounting of handlebar 54 may result in a slight degree of undesirable lateral shifting of the upper body of person 2. Handlebar 320 includes a first tubular member or post 330 that extends downward towards frame 4, and a second tubular member or post 340 that extends downward into anterior sleeve 10 of frame 4 for securing handlebar 320 to frame 4 in a manner similar to the typical attachment of bicycle handlebar to a bicycle frame. First post 330 is separated from second post 340 by a lateral spacer portion 350. As a result, handlebar 320 is asymmetrically mounted to frame 4. It should be readily appreciated that quick disconnect mechanism 62 facilitates adjustments to the height of handlebar 320, and allows handlebar 320 to be rotated 180 degrees about a vertical axis (roughly defined by anterior sleeve 10) for moving handlebar 320 between a first predetermined position which may tend to shift the upper body to the left and a second predetermined position which may tend to shift the upper body to the right (see directional arrows 360).

FIG. 4 is a front view of yet another alternative handlebar 420 according to the present invention. It should be appreciated that handlebar 420 may be substituted for handlebar 54 in cart 3 (see FIG. 1). As noted above in connection with FIG. 2 and FIG. 3 above, the symmetrical mounting of handlebar 54 may result in a slight degree of undesirable lateral shifting of the upper body of person 2. Handlebar 420 includes a tubular member or post 430 that extends downward for insertion into anterior sleeve 10 of frame 4 in order to secure handlebar 420 to frame 4 in a manner similar to the typical attachment of bicycle handlebar to a bicycle frame (frame 4 is not shown in FIG. 4). Post 430 defines a transverse passageway 440 that is roughly perpendicular to post 430. Handlebar 420 further includes a crossbar 450 that extends through passageway 440 and is secured therein by a quick disconnect mechanism 460 or any other suitable device. Handgrip 66 and handgrip 70 are fitted onto crossbar 450. Quick disconnect mechanism 62 (see FIG. 1) facilitates adjustments to the height of handlebar 420. Meanwhile, operation of quick disconnect mechanism 460 allows crossbar 450 to be moved from side to side (see linear directional lines 470) between a virtually infinite number of positions which may be used to shift the upper body to the left or to the right.

FIG. 5 is a bottom view of cart 3 (see also FIG. 1) with first rear wheel 32 and second rear wheel 34 positioned to accommodate a person having a non-ambulatory lower left leg and an ambulatory right leg. Adjusting cart 3 to this state may require removing bolt 50, pulling coupling bar 40 away from frame 4 in the direction of directional arrow 86, flipping or rotating coupling bar 40 180 degrees in the direction of directional arrow 90 (FIG. 6), and re-securing coupling bar 40 to frame 4 with bolt 50.

FIG. 6 is a bottom view of cart 3 (see also FIG. 1) with first rear wheel 32 and second rear wheel 34 positioned to accommodate a person having a non-ambulatory lower right leg and an ambulatory left leg. Adjusting cart 3 to this state may require removing bolt 50, pulling coupling bar 40 away from frame 4 in the direction of directional arrow 86, flipping or rotating coupling bar 40 180 degrees in the direction of directional arrow 94 (FIG. 5), and re-securing coupling bar 40 to frame 4 with bolt 50.

After the user ensures that first rear wheel 32 and second rear wheel 34 are appropriately positioned, the user adjusts the height of leg support 14 and handlebar 54 by disengaging quick disconnect mechanism 20 and quick disconnect mechanism 62, respectively, moving leg support 14 and handlebar 54 as desired, and re-engaging quick disconnect mechanism 20 and quick disconnect mechanism 62.

Figure 7:
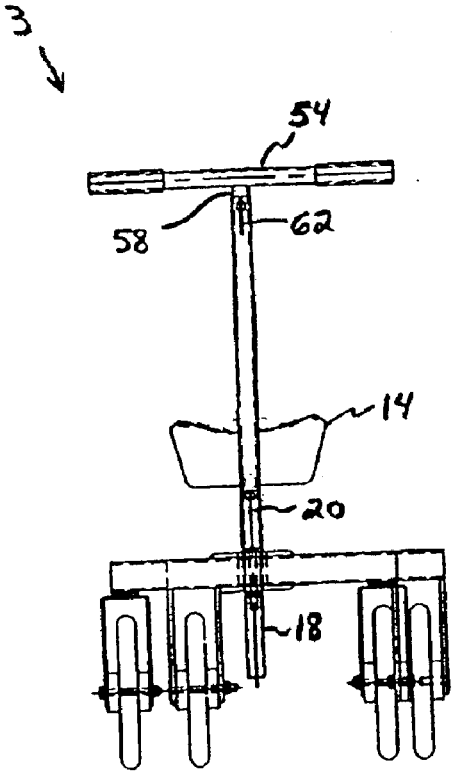
FIG. 7 is a front view of the cart of FIG. 1 with its leg support and handlebar in lowered positions.
Figure 8:
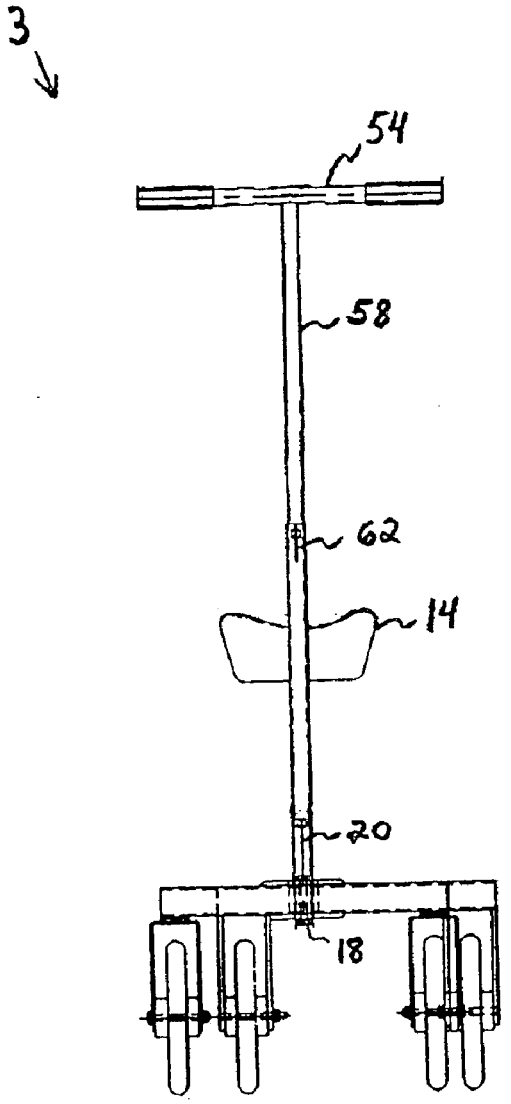
FIG. 8 is a front view of the cart of FIG. 1 with its leg support and handlebar in raised positions.
Figure 9:
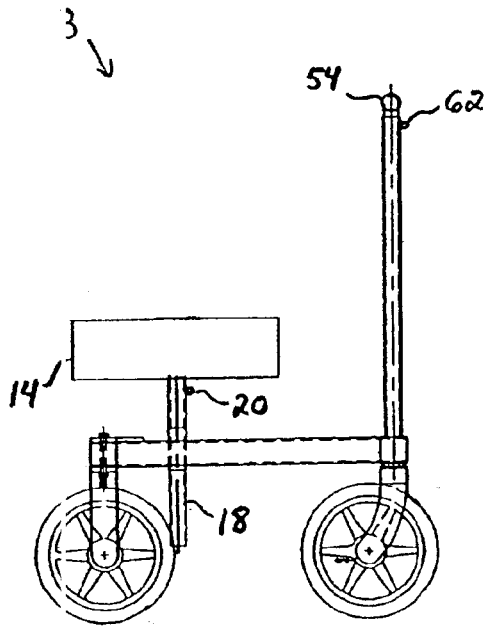
FIG. 9 is a side view of the cart of FIG. 1 with its leg support in a lowered position and its handlebar in a lowered position.
Figure 10:
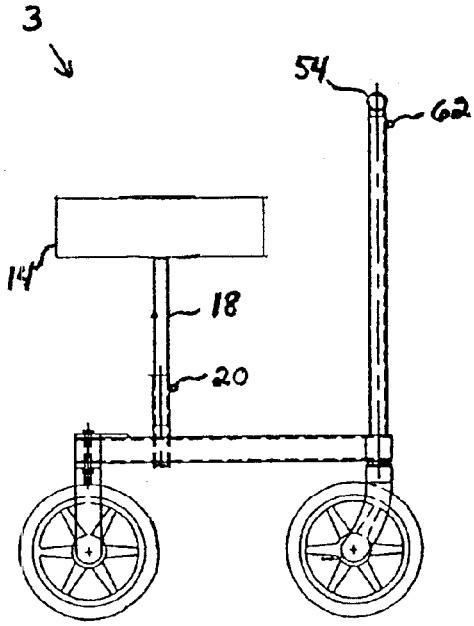
FIG. 10 is a is a side view of the cart of FIG. 1 with its leg support in a raised position and its handlebar in a lowered position.

FIG. 7 is a front view of cart 3 with leg support 14 and handlebar 54 in lowered positions, and FIG. 8 is a front view of the cart 3 with leg support 14 and handlebar 54 in raised positions. Here, it is noted that although FIG. 7 and FIG. 8 show both leg support 14 and handlebar 54 in lowered and raised positions, respectively, leg support 14 and handlebar 54 may be adjusted independently of one another. For example, FIG. 9 is a side view of cart 3 with leg support 14 in a lowered position and handlebar 54 in a lowered position, while FIG. 10 is a is a side view of cart 3 with leg support 14 in a raised position and handlebar 54 in a lowered position. Further, it should be readily appreciated that the in the embodiment shown in FIG. 1, the user is not restricted to just one lowered and one raised position. Similar to adjusting a typical bicycle seat or bicycle handlebar, such adjustments may be made with practically infinite resolution.

For locomotion, the user places the non-ambulatory lower leg on the leg support 14, places hand(s) on handgrip 66 and/or handgrip 70, and scoots cart 3 with the ambulatory leg (see FIG. 1). Accordingly, the user moves about, steering cart 3 by exerting various upper body forces on handlebar 54 and/or by exerting various lower body forces on leg support 14. Braking is applied by activating handbrake 74 as necessary. Further, the user maneuvers cart 3 over door thresholds or similar obstacles while still supporting the non-ambulatory lower leg simply by lifting up on handlebar 54 to clear the obstruction. Thus, it should be appreciated that cart 3 may be used on most reasonably level surfaces and moderate inclines. It may also be used on slightly uneven surfaces such as grass or gravel as handlebar 54 may be used to lift or pull cart 3 forward with each stride. It should be appreciated that cart 200 (FIG. 2) and cart 300 (FIG. 3) are operated in a similar fashion to cart 3, with the added adjustment of the asymmetrical position of handlebar 220 and handlebar 320, respectively, as desired.

The foregoing description of the invention is illustrative only, and is not intended to limit the scope of the invention to the precise terms set forth. Further, although the invention has been described in detail with reference to certain illustrative embodiments, variations and modifications exist within the scope and spirit of the invention as described and defined in the following claims.

What is claimed is:

1. A cart for an injured person, comprising:

a frame;

a leg support member coupled to the frame;

a plurality of wheels coupled to the frame; and a handlebar coupled to the frame; wherein the handlebar is moveable at least between a first asymmetrical handlebar position relative to the frame and a second asymmetrical handlebar position relative to the frame, thereby accommodating a person having a non-ambulatory lower left leg or a non-ambulatory lower right leg, respectively.

2. The cart of claim 1, wherein the first asymmetrical handlebar position corresponds to the handlebar being offset to a first side of the frame and the second asymmetrical handlebar bar position corresponds to the handlebar being offset to a second side of the frame.

3. The cart of claim 2, wherein the handlebar is rotatably moveable between the first handlebar position and the second handlebar position.

4. The cart of claim 2, wherein the handlebar includes a post and a crossbar moveably coupled to the post, the post configured to be received by a sleeve of the frame and the crossbar configured to be moveable between a plurality of asymmetrical handlebar positions including the first handlebar position and the second handlebar position.

5. The cart of claim 3, further comprising a quick disconnect mechanism configured to couple the handlebar to the frame.

6. The cart of claim 3, further comprising means for coupling the handlebar to the frame.

7. The cart of claim 4, further comprising a quick disconnect mechanism configured to couple the post to the frame.

8. The cart of claim 4, further comprising means for coupling the post to the frame.

9. The cart of claim 4, further comprising a quick disconnect mechanism configured to couple the crossbar to the post.

10. The cart of claim 4, further comprising means for coupling the crossbar to the post.

11. The cart of claim 1, wherein an upper portion of the leg support member is configured to center the non-ambulatory lower left leg or the non-ambulatory lower right leg relative to the leg support member.

12. The cart of claim 11, wherein the upper portion includes a generally concave surface configured to center the non-ambulatory lower left leg or the non-ambulatory lower right leg relative to the leg support member.

13. The cart of claim 1, wherein the handlebar is moveable to at least a third handlebar position, the third handlebar position being an asymmetrical handlebar position.

14. The cart of claim 1, wherein the leg support member is moveably coupled to the frame such that a first height of the leg support member relative to the floor is adjustable independent of a second height of the handlebar relative to the floor.

15. The cart of claim 1, wherein the plurality of wheels includes a first wheel and a second wheel, the first wheel being positioned on a first side of the leg support member and the second wheel being positioned on a second side of the leg support member, the first wheel and the second wheel being spaced apart by a spacing greater than a width of the leg support member.

16. The cart of claim 15, wherein the first wheel and the second wheel are both positioned generally below the handlebar and forward of the leg support member.

17. The cart of claim 16, wherein the first wheel and the second wheel are each rotatable about respective vertical axes to aid in the steering of the cart.

18. The cart of claim 1, wherein at least a first wheel of the plurality of wheels is located outside of a footprint of the leg wheel support member.

19. The cart of claim 1, wherein at least a first wheel and a second wheel of the plurality of wheels is located outside of a footprint of the leg wheel support member.

20. The cart of claim 19, wherein the first wheel being positioned on a first side of the leg support member and the second wheel being positioned on a second side of the leg support member.

* * * * *